US006864874B1

(12) United States Patent
Ozawa

(10) Patent No.: US 6,864,874 B1
(45) Date of Patent: Mar. 8, 2005

(54) DRIVING CIRCUIT FOR ELECTRO-OPTICAL DEVICE, ELECTRO-OPTICAL DEVICE, AND ELECTRONIC EQUIPMENT

(75) Inventor: Tokuro Ozawa, Sawa (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 09/689,658

(22) Filed: Oct. 13, 2000

(30) Foreign Application Priority Data

Oct. 15, 1999 (JP) ..... 11-294397

(51) Int. Cl.[7] ..... G09G 3/36; G09G 5/00

(52) U.S. Cl. ..... 345/99; 345/98; 345/100; 345/205

(58) Field of Search ..... 345/87–90, 92, 345/93, 94, 98, 99, 100, 103, 204–213

(56) References Cited

U.S. PATENT DOCUMENTS 4,766,430 A * 8/1988 Gillette et al. ..... 345/89
5,192,945 A * 3/1993 Kusada ..... 345/88
5,414,443 A * 5/1995 Kanatani et al. ..... 345/95
5,600,345 A * 2/1997 Dingwall et al. ..... 345/100
6,034,666 A * 3/2000 Kanai et al. ..... 345/593
6,069,605 A 5/2000 Ozawa
6,100,879 A * 8/2000 Da Costa ..... 345/211
6,175,351 B1 * 1/2001 Matsuura et al. ..... 345/98
6,256,024 B1 * 7/2001 Maeekawa ..... 345/205
6,313,830 B1 11/2001 Yusa

FOREIGN PATENT DOCUMENTS

CN 1138904 A 12/1996
CN 1209567 A 3/1999
JP 04-195189 7/1992
JP 10-319429 12/1998
JP 11-85111 3/1999

* cited by examiner

*Primary Examiner*—Amr A. Awad
(74) *Attorney, Agent, or Firm*—Oliff & Berridge, PLC

(57) ABSTRACT

An electro-optical device is provided that can accurately supply voltages, which correspond to analog image signals, to pixels without being affected by switching noise and leakage, and that can perform high speed sampling of analog image signals. An analog image signal is first held in a capacitor. Thereafter, this analog image signal is converted by an A/D converter into a digital signal in a time that is shorter than one horizontal scanning period. Subsequently, the digital signal is held in a latch. Further, when the analog image signal is applied to a data line, the transfer of the digital signal from the latch to another latch and the D/A conversion thereof by a D/A converter are performed.

15 Claims, 11 Drawing Sheets

DRIVING CIRCUIT FOR ELECTRO-OPTICAL DEVICE, ELECTRO-OPTICAL DEVICE, AND ELECTRONIC EQUIPMENT

BACKGROUND OF THE INVENTION

1. Field of Invention

This present invention generally relates to a driving circuit for an electro-optical device, and an electro-optical device, and electronic equipment using this electro-optical device as a display device.

2. Description of Related Art

An active matrix liquid crystal panel is known as an electro-optical device. This active matrix liquid crystal panel is constituted by filling and sealing the gap between a device substrate and an opposing substrate with liquid crystal serving as an electro-optical material. FIG. 10 is a block diagram illustrating the configuration of a liquid crystal panel 1 as an example of such an active matrix liquid crystal panel. In addition to this liquid crystal panel 1, FIG. 10 shows a timing signal generating circuit 2 and a γ-correction circuit 3, which are peripheral circuits of the liquid crystal panel 1. Each of these peripheral circuits is constituted by one or a plurality of semiconductor integrated circuits.

Before describing the configuration of the liquid crystal panel 1, these peripheral circuits are described hereinbelow. The timing signal generating circuit 2 is operative to generate various timing signals for controlling operation timing of each component of the liquid crystal panel 1. Among timing signals generated by this timing signal generating circuit 2, primary timing signals are a scanning-line selection pulse G, a data-line selection pulse DS, and selection signals SELA and SELB. Incidentally, one scanning-line selection pulse G is outputted in each frame time (or each vertical scanning period) from the timing signal generating circuit 2. Further, one data-line selection pulse DS is outputted during every horizontal scanning period in each frame time. Furthermore, the selection signals SELA and SELB are such that the signal levels of the signals SELA and SELB exclusively change in synchronization with the horizontal scanning period. That is, in the case that the signal level of the selection signal SELA is a high level in, for example, each odd-numbered horizontal scanning period, the signal level of the selection signal SELB is a high level in each even-numbered horizontal scanning period.

The γ-correction circuit 3 is operative to perform a γ-correction on analog image signals supplied to the liquid crystal panel 1. That is, each pixel (to be described later) of the liquid crystal panel 1 has a characteristic that the gradation level thereof nonlinearly changes according to a voltage applied thereto. Thus, a nonlinear conversion (namely, a γ-correction) represented by an inverse function of a function representing the nonlinear characteristic of each pixel is preliminarily performed on an analog image signal by this γ-correction circuit 3. Then, resultant signals are supplied to the liquid crystal panel 1, so that the gradation level of each pixel linearly changes according to the analog image signal.

Next, the liquid crystal panel 1 is described hereinafter. As described above, this liquid crystal panel 1 is constituted by filling and sealing the gap between the device substrate and the opposing substrate with liquid crystal serving as an electro-optical material. Incidentally, as illustrated in FIG. 10, M parallel scanning lines 11-i (i=1 to M) and N parallel data lines 12-j (j=1 to N), each intersecting with the scanning lines, are formed on the device substrate of the liquid crystal panel 1. Further, M×N pairs of a pixel Qij (i=1 to M, j=1 to N) and a switching transistor Tij (i=1 to M, j=1 to N) are formed at intersections between the scanning lines 11-i (i=1 to M) and the data lines 12-j (j=1 to N), respectively.

Each pixel Qij (i=1 to M, j=1 to N) consists of a pixel electrode provided on the device substrate, an opposing electrode provided on the opposing substrate, and a liquid crystal layer sandwiched between the pixel electrode and the opposing electrode. Each switching transistor Tij (i=1 to M, j=1 to N) is constituted by a TFT (Thin Film Transistor) formed on the device substrate.

Each data line 12-j is a wire for transmitting an analog image signal, according to which the gray scale levels of pixels are determined, and connected to the source of each of M switching transistors Tij (i=1 to M) of the same column number as the column number thereof. Further, each scanning line 11-i is a wire for transmitting selection voltage pulses, in response to which an analog image signal writing command is issued, and connected to the gate of each of N switching transistors Tij (j=1 to N) of the same row number as the row number thereof. The drain of the switching transistor Tij (i=1 to M, j=1 to N) is connected to the pixel electrode of the pixel Qij (i=1 to M, j=1 to N). Each of the switching transistors Tij (i=1 to M, j=1 to N) is conducted by applying a selection voltage to the gate thereof through the scanning line 11-i. An analog image signal provided on the data line 12-j, which is connected to the source of each of the switching transistors, is applied to the pixel electrode of the pixel Qij.

A scanning line driving circuit 13, a data line driving circuit 14, and N sampling circuits 15-j (j=1 to N) are formed on the device substrate of the liquid crystal panel 1, in addition to the aforementioned components.

The scanning line driving circuit 13 is operative to sequentially supply selection voltages Gi (i=1 to M) to the scanning lines 11-i (i=1 to M) during each horizontal scanning period in one frame time (or one vertical scanning period) under the control of the timing signal generating circuit 2. This scanning line driving circuit 13 can be constituted by a shift register adapted to serially shift, for example, the scanning selection pulse G. In the case of using this shift register, this scanning line driving circuit 13 should be configured so that a pulse obtained from each stage of this shift register is supplied to the corresponding scanning line 11-i (i=1 to M).

The data line driving circuit 14 is operative to sequentially output N sampling pulses SPj (j=1 to N) when the selection voltage is outputted to each of the scanning lines. This data line driving circuit 14 can be constituted by, for instance, a shift register adapted to sequentially shift the data-line selection pulses DS. In the case of using this shift register, the data line driving circuit 14 should be configured so that the sampling pulses SPj (j=1 to N) are extracted from the stages of this shift register.

The sampling circuits 15-j (j=1 to N) are provided correspondingly to the data lines 12-j (j=1 to N), respectively. The selection signals SELA and SELB are supplied to each of the sampling circuits 15-j (j=1 to N). Furthermore, each of the sampling circuits 15-j (j=1 to N) is supplied with a corresponding one of sampling pulses SPj (j=1 to N) in each horizontal scanning period.

Each of the sampling circuits 15-j (j=1 to N) is constituted by connecting analog switches SA-j, SB-j, SC-j, SD-j, and SS-j, voltage follower buffers BUFA-j and BUFB-j and capacitors CA-j and CB-j to one another, as illustrated in this figure.

Each of the analog switches SA-j, . . . is constituted by a TFT provided on the device substrate. Incidentally, the analog switch SS-j is conducted by being supplied with a high-level sampling pulse SPj. Further, the analog switch SA-j is conducted only when the selection signal SELA is at a high level. Moreover, the analog switch SB-j is conducted only when the selection signal SELA is at a low level. Furthermore, the analog switch SC-j is conducted only when the selection signal SELB is at a high level. Additionally, the analog switch SD-j is conducted only when the selection signal SELB is at a low level.

FIG. 11 is a timing chart illustrating an operation of the aforementioned liquid crystal panel. Hereinafter, an operation of the conventional active matrix liquid crystal display device is described hereunder with reference to this timing chart.

As illustrated in FIG. 11, in each frame time, selection voltage pulses G1, G2, . . . are serially and respectively outputted during horizontal scanning periods. Furthermore, the levels of the selection signals SELA and SELB are exclusively changed in synchronization with the horizontal scanning period.

In an example illustrated in FIG. 11, in a first horizontal scanning period in which the selection voltage pulse G1 is outputted, the selection signal SELA is at a high level, while the selection signal SELB is at a low level. Thus, among the sampling circuits 15-j (j=1 to N), the analog switches SA-j and SD-j are conducted, while the analog switches SB-j and SC-j are in a non-conducting condition.

In this state, when the sampling pulses SPj (j=1 to N) are serially outputted from the data line driving circuit 14, the analog switches SS-j of the sampling circuits 15-j (j=1 to N) are serially conducted. Then, analog image signals corresponding to the pixels, which are serially outputted from the γ-correction circuit 3, are sequentially applied to the capacitors CA-j (j=1 to N) through the analog switches SS-j (j=1 to N) and SA-j (j=1 to N). Subsequently, the applied analog image signals are held by the capacitors.

During this time, voltage signals written to the capacitors CB-j (j=1 to N) of the sampling circuits 15-j (j=1 to N) in the immediately preceding horizontal scanning period are outputted to the data lines 12-j (j=1 to N) through the analog switches SD-j (j=1 to N). The voltage outputted to each of the data lines 12-j (j=1 to N) is applied to the pixels Q1j (j=1 to N) of the first row through the switching transistors T1j (j=1 to N) when the selection voltage pulse G1 is at the high level. In FIG. 11, hatched parts of the voltage signals outputted from the capacitors CB-j (j=1 to N) to the data lines 12-j (j=1 to N) are applied to the pixel electrodes of the pixels Q1j (j=1 to N).

Subsequently, in a second horizontal scanning period in which the selection voltage pulse G2 is outputted, the selection signal SELA is at the low level, while the selection signal SELB is at the high level. Thus, in the sampling circuits 15-j (j=1 to N), the analog switches SB-j and SC-j are conducted, while the analog switches SA-j and SD-j are in a non-conducting condition.

In this state, when the sampling pulses SPj (j=1 to N) are serially outputted from the data line driving circuit 14, the analog switches SS-j of the sampling circuits 15-j (j=1 to N) are serially conducted. Then, analog image signals corresponding to the pixels, which are serially outputted from the γ-correction circuit 3, are sequentially applied to the capacitors CB-j (j=1 to N) through the analog switches SS-j (j=1 to N) and SB-j (j=1 to N). Subsequently, the applied analog image signals are held by these capacitors.

During this, voltage signals written to the capacitors CA-j (j=1 to N) of the sampling circuits 15-j (j=1 to N) in the immediately preceding horizontal scanning period are outputted to the data lines 12-j (j=1 to N) through the analog switches SC-j (j=1 to N). The voltage outputted to each of the data lines 12-j (j=1 to N) is applied to the pixels Q2j (j=1 to N) of the second row through the switching transistors T2j (j=1 to N) when the selection voltage pulse G2 is at the high level. In FIG. 11, hatched parts of the voltage signals outputted from the capacitors CA-j (j=1 to N) to the data lines 12-j (j=1 to N) are applied to the pixel electrodes of the pixels Q2j (j=1 to N).

In the subsequent horizontal scanning periods, similar operations are repeated. Thus, the analog image signals respectively corresponding to all pixels of one screen are applied to the pixel electrodes of the pixels Qij (i=1 to M, j=1 to N) of the liquid crystal panel 1.

In each of the pixels Qij (i=1 to M, j=1 to N), the alignment of liquid crystal molecules between the pixel electrode and the opposing electrode changes according to the voltage applied thereto, so that the transmittance of this pixel changes. Consequently, each of the pixels is displayed at a gradation level corresponding to the level of the corresponding analog image signal.

SUMMARY OF THE INVENTION

In the aforementioned conventional liquid crystal panel, the analog image signals inputted from an external circuit are held therein as remaining analog signals, and supplied to the pixels. Thus, during the holding and supplying processes, the analog image signals are susceptible to noise generated by the switching of the sampling switches SS-j (j=1 to N). Thus, it is difficult to apply the analog image signals to the pixels by maintaining the magnitudes of these signals. This is a hindrance to the improvement of the picture quality of an image to be displayed.

Further, especially, in the case of a large liquid crystal panel, extremely high parasitic capacitance is associated with each of the data lines. The value of the parasitic capacitance may be of the order of 1 nF. Such a large liquid crystal panel needs a large driving force so as to drive the data lines. The liquid crystal panel 1 illustrated in FIG. 10 has the buffers BUFA-j (j=1 to N) and BUFB-j (j=1 to N) in order to drive the data lines 12-j (j=1 to N), each having such high parasitic capacitance. Incidentally, to obtain image displays of high picture quality, a voltage accurately corresponding to the analog image signal supplied to the liquid crystal panel 1 should be applied to the data lines 12-j (j=1 to N) and used for driving the pixels.

However, in the case of a liquid crystal panel using TFTs, these buffers are constituted by operational amplifiers using TFTs. Incidentally, when TFTs are manufactured, there are large variations in a threshold value and in what is called a K parameter (namely, a parameter obtained by dividing the mutual conductance of a transistor by (the channel width/the channel length) thereof). Thus, offsets due to the manufacturing variation in a threshold value and a K parameter of a TFT may occur in the buffers BUFA-j (j=1 to N) and BUFB-j (j=1 to N). Consequently, a voltage deviated from the voltage corresponding to the original analog image signal is applied to each of the data lines. This may result in deterioration in the picture quality of image displays.

To eliminate such drawbacks, there is the necessity for taking countermeasures, for example, for providing a circuit enabled to cancel the offset of the operational amplifier in the liquid crystal panel, or for performing trimming on individual liquid crystal panels to thereby cancel the offset of the operational amplifier. However, when such countermeasures are taken, another drawback may occur in that the manufacturing cost increases.

Further, in the case of the conventional liquid crystal panel 1, after analog image signals are sequentially written to the capacitors CA-j (j=1 to N) and CB-j (=1 to N) in response to the sampling pulses SPj (j=1 to N) in a certain horizontal scanning period, these analog image signals are applied to the data lines 12-j (j=1 to N) in the next horizontal scanning period. During this, the analog image signals held in the capacitors CA-j (j=1 to N) and CB-j (j=1 to N) are attenuated by the leakage thereof. However, in the case that the attenuation amount thereof is large, the contrast of the displayed image may be reduced. Moreover, as illustrated in FIG. 11, for example, in the case of the capacitor CA-1 corresponding to the pixel of the first column, the analog image signal is written thereto at the beginning of a horizontal scanning period. Thus, the analog image signal written thereto may be extremely largely attenuated until the next horizontal scanning period begins. In contrast, in the case of the capacitor CA-N corresponding to the pixel of the Nth column, the analog image signal is written thereto at the end of a horizontal scanning period. Thus, the attenuation amount of the analog image signal written thereto until the beginning of the next horizontal scanning period may be relatively small. In the case where the written analog image signals are attenuated so that the attenuation amounts thereof vary with the order, in which the corresponding analog image signal is written, of the pixel, the degree of contrast of the displayed image may change in a lateral direction of the screen.

To eliminate at least such a drawback, the magnitude of each of the analog image signals held in the capacitors CA-j (j=1 to N) or CB-j (j=1 to N) is maintained at an almost constant level for a long term, that is, one horizontal scanning period. For that, there is need for increasing the capacitance of each of these capacitors. However, an increase in the capacitance thereof may result in a reduction in the speed at which an operation of writing the analog image signals to the capacitors. Consequently, the conventional liquid crystal panel has another drawback that may be difficult to drive this liquid crystal panel at a high speed.

The present invention is accomplished at least in view of the aforementioned circumstances. Accordingly, an object of the present invention is to at least provide an electro-optical device that can accurately supply voltages, which correspond to analog image signals, to pixels without being affected by the switching noise and the leakage, and that can perform high speed sampling of analog image signals, and to provide electronic equipment using this electro-optical device as a display device.

According to one exemplary embodiment of the present invention, there is provided a driving circuit for an electro-optical device for performing image display by driving a plurality of pixels formed in a matrix on a substrate according to an analog image signal, which may consist of an A/D conversion circuit for converting the analog image signal into a digital signal, a storage device for storing the digital signal, and a D/A conversion circuit for converting the digital signal, which is stored in the storage device, into an analog signal and for supplying the analog signal to the pixels.

According to such a driving circuit for an electro-optical device, an inputted analog image signal is converted into a digital signal. Then, the analog image signal is stored in the storage device in the form of the digital signal until supplied to the pixels. Therefore, the input analog image signal can be supplied to the pixels without being deteriorated.

This driving circuit for an electro-optical device may further consist of a plurality of sampling circuits, which are provided on the substrate, for sequentially sampling and holding the analog image signal inputted in one horizontal scanning period. The A/D conversion circuit may consist of a plurality of A/D converters for converting analog image signals held in-the plurality of sampling circuits into digital signals. The storage device may store a plurality of digital signals obtained from the plurality of A/D converters. The D/A conversion circuit may consist of a plurality of D/A converters for converting a plurality of digital signals stored in the storage device into analog signals and for supplying the analog signals to a plurality of pixels.

In this case, the plurality of A/D converters and the storage device may be adapted so that the plurality of A/D converters convert analog image signals held in the plurality of sampling circuits into digital signals within a time, which is shorter than the one horizontal scanning period, since the analog image signals are held therein, and that the storage device stores the digital signals.

Further, instead of constituting the A/D conversion circuit by the plurality of A/D converters, this driving circuit may be adapted so that the storage device stores a plurality of digital signals obtained from the A/D conversion circuit within a fixed time, and that the D/A conversion circuit may consist of a plurality of converters for converting a plurality of digital signals stored in the storage device into analog signals and for supplying the analog signals to a plurality of pixels.

In this case, this driving circuit may consist of a path for supplying a digital signal obtained from the A/D conversion circuit to the storage device, and a path for supplying a digital signal received from an external circuit to the storage device.

Such a driving circuit for an electro-optical device can be applied to both the case of dealing with analog image signals and the case of dealing with digital image signals. Therefore, in the case of manufacturing a plurality of kinds of electronic equipment requiring an electro-optical device, the electro-optical device serving as a part of the electronic equipment can be shared thereamong. Consequently, the manufacturing cost thereof can be reduced.

Furthermore, in the aforementioned driving circuit for an electro-optical device, the D/A conversion circuit may be constituted by a D/A converter for generating an analog signal, which is obtained by performing nonlinear conversion, such as γ-correction, on an analog signal corresponding to a digital signal stored in said storage device, from the digital signal.

With such configuration, there is no need for providing a separate analog circuit for γ-correction in the driving circuit. Consequently, the configuration of the driving circuit can be simplified.

The driving circuit of the present invention is suitable for a TFT active matrix liquid crystal panel constituted by forming thin film transistors on the substrate.

An electro-optical device having a driving circuit therefor according to the present invention is singly manufactured and sold. Moreover, such an electro-optical device is used as a display device for various kinds of electronic equipment, such as a projector and a computer.

DETAILED DESCRIPTION OF PREFERRED EMBODIMENTS

Hereinafter, embodiments of the present invention will be described with reference to the accompanying drawings.

A. First Exemplary Embodiment

Figure 1:
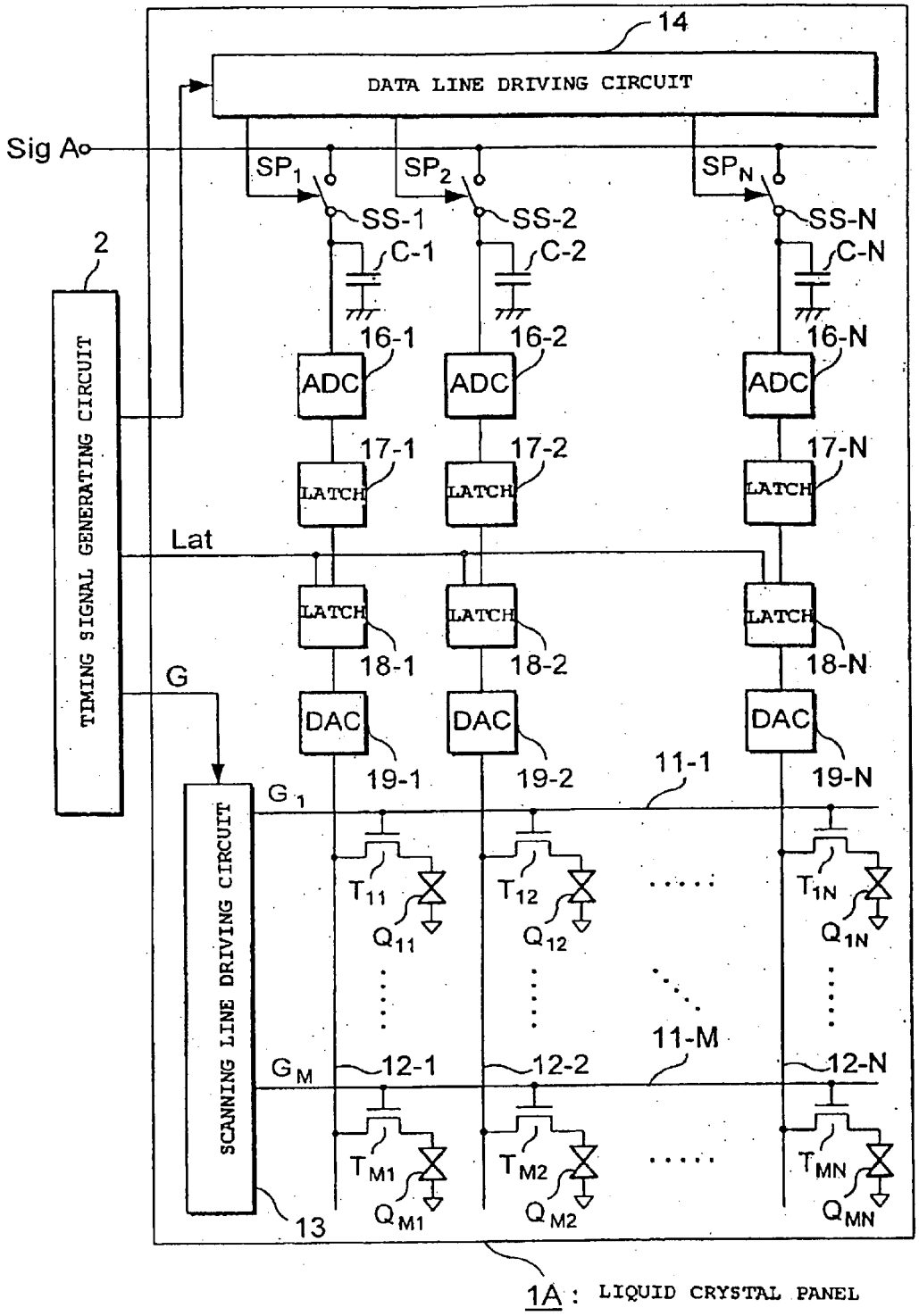
FIG. 1 is a block diagram illustrating the configuration of a liquid crystal panel according to a first exemplary embodiment of the present invention.
Figure 10:
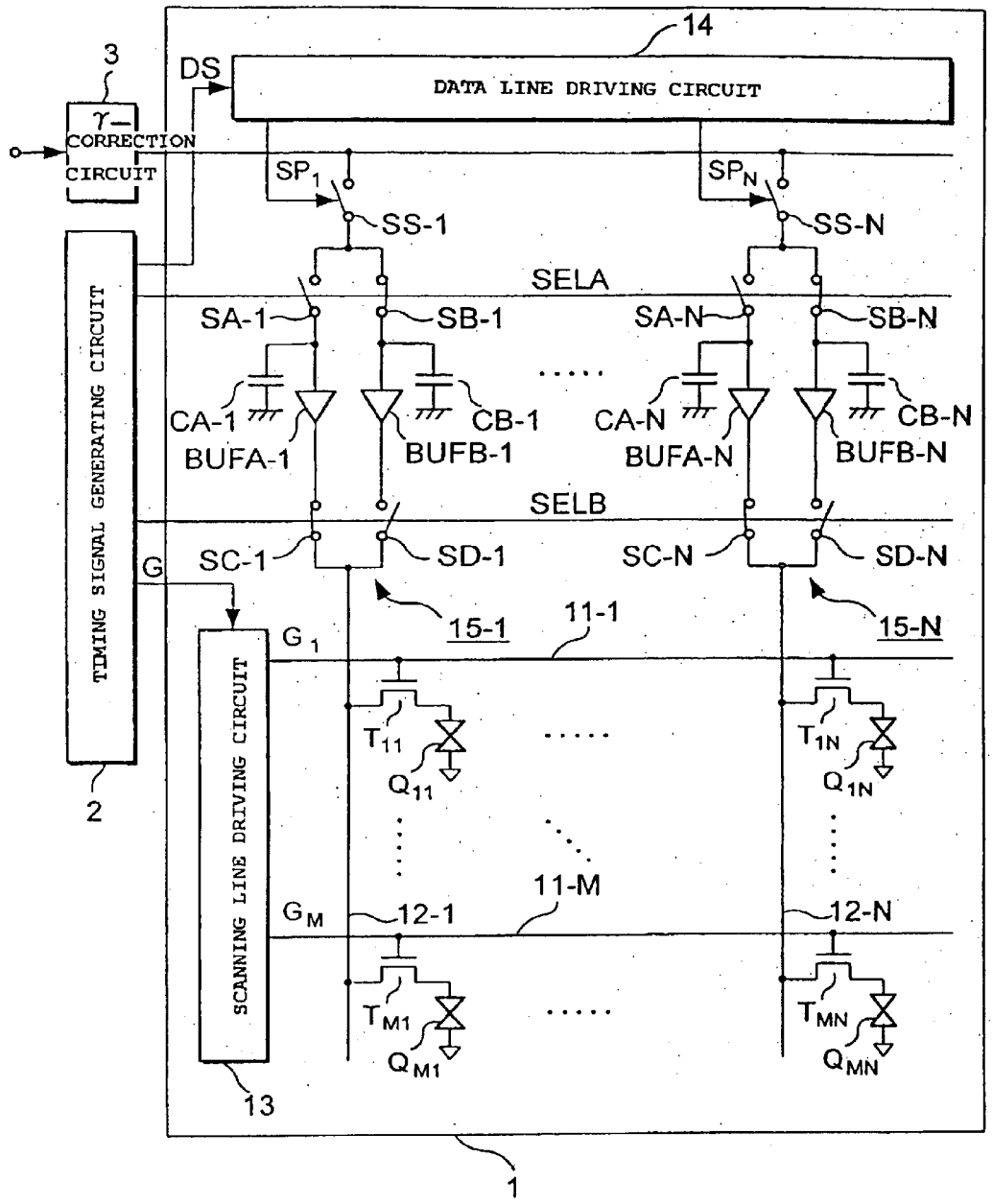
Fig. 10 Conventional Art
FIG. 10 is a block diagram illustrating the configuration of an active matrix liquid crystal panel.
Figure 11:
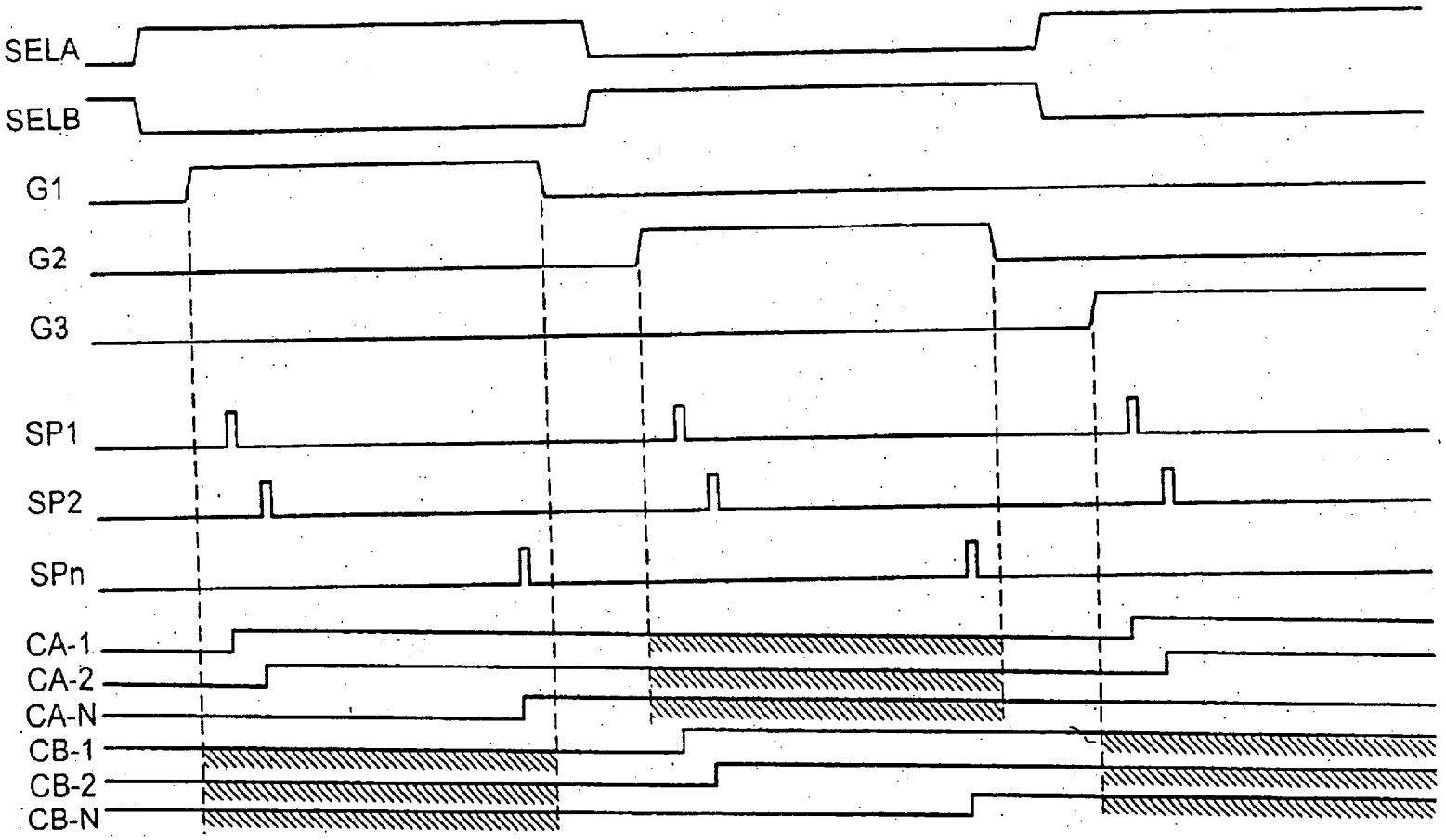
Fig. 11 Conventional Art
FIG. 11 is a timing chart illustrating an operation of a liquid crystal panel.

FIG. 1 is a block diagram illustrating the configuration of an active matrix liquid crystal panel 1A, which is a first exemplary embodiment of the electro-optical device of the present invention. Incidentally, in this figure, like reference characters designate portions corresponding to the components of the liquid crystal panel 1 illustrated in FIG. 10. The description of such portions is omitted.

This liquid crystal panel 1A includes sampling switches SS-j (j=1 to N), capacitors C-j (j=1 to N), A/D converters 16-j (j=1 to N), first latches 17-j (j=1 to N), second latches 18-j (j=1 to N), and D/A converters 19-j (j=1 to N), correspondingly to data lines 12-j (j=1 to N).

These devices of the circuit are formed on the device substrate together with the pixel electrodes and the switching transistors of the pixels.

The A/D converters 16-j (j=1 to N) are, for instance, successive approximation A/D converters. The analog input terminals of these A/D converters 16-j (j=1 to N) are connected through the sampling switches SS-j (j=1 to N) to signal lines for inputting analog image signals. Further, the analog signal input terminal of each of the A/D converters 16-j (j=1 to N) is connected to one of electrodes of a corresponding one of the capacitors C-j (j=1 to N), the other electrode of each of which is grounded.

The A/D converters 16-j (j=1 to N) are operative to convert analog signals held in the capacitors C-j (j=1 to N) into digital signals and to output the digital signals. Incidentally, A/D conversion is started by each of the A/D converters 16-j (j=1 to N) within a time, which is shorter than one horizontal scanning period, after a corresponding one of the sampling switches SS-j (j=1 to N) is put into an on-state and an analog image signal is written to a corresponding one of the capacitors C-j (j=1 to N).

Just upon completion of the A/D conversion by the corresponding A/D converter 16-j (j=1 to N), each of the first latches 17-j (j=1 to N) holds digital signals outputted from a corresponding one of the A/D converters 16-j (j=1 to N).

Figure 2:
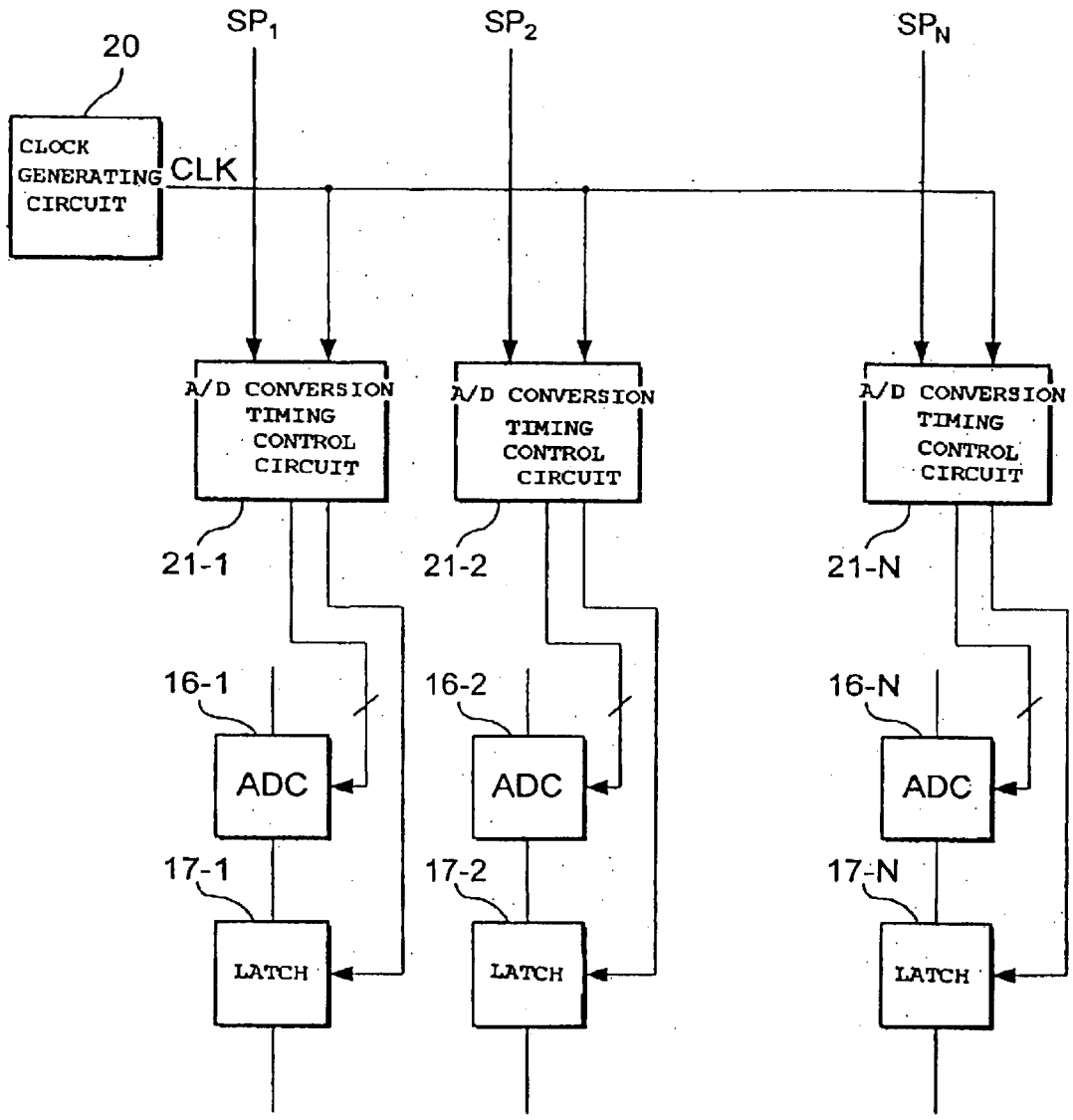
FIG. 2 is a block diagram illustrating the configuration of a timing control circuit of the first exemplary embodiment.

Although various kinds of a timing control circuit for controlling operation timing of the A/D converters 16-j (j=1 to N) and the first latches 17-j (j=1 to N) can be designed, such a circuit in this embodiment is configured as illustrated in FIG. 2.

Figure 3:
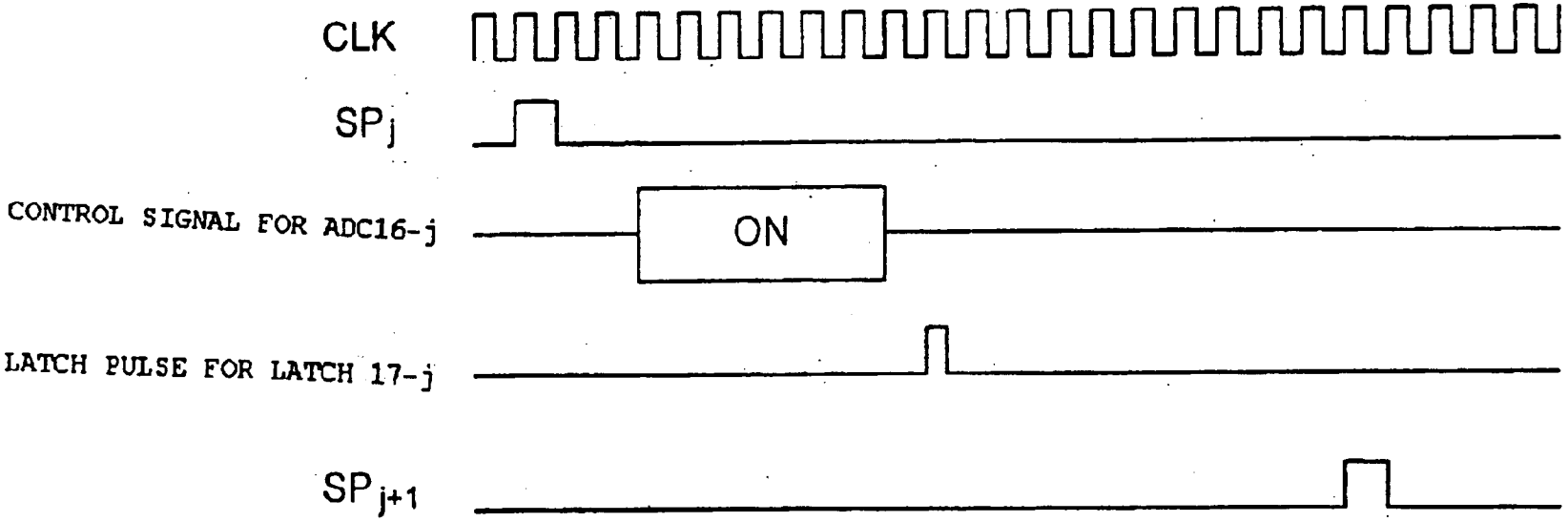
FIG. 3 is a timing chart illustrating an operation of the timing control circuit.

The timing control circuit illustrated in FIG. 2 has a clock generating circuit 20 and N A/D conversion timing control circuits 21-j (j=1 to N). Incidentally, the clock generating circuit 20 is operative to output clock pulses CLK of constant frequency, as illustrated in FIG. 3. Further, after a predetermined number of clock pulses CLK are outputted since the sampling pulse SPj is outputted, each of the A/D conversion timing control circuits 21-j outputs a sequence of timing control signals which are necessary for a corresponding one of the A/D converters 16-j to perform A/D conversion and to output one digital signal, in synchronization with the clock pulses CLK. Thereafter, the A/D conversion timing control circuits 21-j output latch pulses which are necessary for writing the digital signal outputted from the A/D converters 16-j to the first latches 17-j.

Thus, in this embodiment, the analog image signals sampled in response to the sampling pulses SPj and held in the capacitors C-j are then converted into digital signals within a time which is shorter than one horizontal scanning period. Subsequently, the digital signals are held by the first latches 17-j. Thus, the capacitance of each of the capacitors C-j (j=1 to N) can be reduced to a value that is smaller than those of the capacitors CA-j (j=1 to N) and CB-j (j=1 to N) of the liquid crystal panel 1 of FIG. 10.

The second latches 18-j (j=1 to N) are operative to hold output data of the first latches 17-j (j=1 to N). With the configuration illustrated in FIG. 1, a latch pulse Lat is supplied from the timing signal generating circuit 2 to the second latches 18-j (j=1 to N) in each horizontal scanning period. Thus, the digital signals of N pixels held in the first latches 17-j (j=1 to N) are transferred to the second latches 18-j (j=1 to N).

The D/A converters 19-j (j=1 to N) are operative to perform D/A conversion on digital signals held in the second latches 18-j (j=1 to N). Incidentally, the D/A converters 19-j (j=1 to N) do not simply convert the digital signal into a corresponding analog signal. That is, the D/A converters 19-j (j=1 to N) performs γ-correction thereon when the D/A conversion is performed. Then, these D/A converters output analog signals, which have undergone the γ-correction, to the data lines 12-j (j=1 to N).

For instance, switched-capacitor D/A converters may be used as the D/A converters 19-j (j=1 to N).

Generally, such a switched-capacitor D/A converter has a plurality of capacitors respectively corresponding to bits represented by a digital signal to be converted, and also has a switching circuit for charging and discharging each of these capacitors. Incidentally, each of these capacitors has a capacitance value corresponding to the weight of each of the bits represented by a digital signal. Further, a reference voltage supplied from a reference power supply is supplied by a switching operation of the switching circuit only to the capacitor corresponding to each of bits whose value is 1, among the bits to be converted. Thereafter, charges held in the capacitors are added thereto. Then, an analog voltage corresponding to the charge after this addition is outputted therefrom. These switched-capacitor D/A converters can be constituted only by capacitors and switching TFTs, without using operational amplifiers. Thus, the D/A conversion can be performed without causing offsets.

Each of the D/A converters 19-j (j=1 to N) of this embodiment is obtained by adding a γ-correction function to this switched-capacitor D/A converter. Hereinafter, an outline of the D/A converter of this embodiment is described by describing the case of the D/A conversion of 3-bit digital data D0 to D2 by way of example, for simplicity of description.

First, this D/A converter has three capacitors respectively corresponding to the 3-bit digital data D0 to D2. The three capacitors have capacitance values Cdac, 2Cdac and 4Cdac, which correspond to the weights of the bits D0 to D2, respectively. Moreover, a switch is interposed between the output terminal of this D/A converter and each of the three capacitors. Incidentally, the output terminal of the D/A converter has a parasitic capacitor whose capacitance value is Cs1n. Furthermore, this D/A converter has a DC power supply for applying a predetermined voltage Vdac to the three capacitors and for applying a predetermined voltage Vs1n to the output terminal of the D/A converter.

With such configuration, the voltage Vdac is applied from the DC power supply to the capacitor corresponding to a bit whose value is 1, among the three capacitors in a state in which the switch is opened. Thereafter, the switch is brought into a conducting state. As a result, charges are transferred among the three capacitors and the output-terminal-side parasitic capacitor. Then, a voltage V given by the following equation is outputted from the output terminal of the D/A converter:

$$V=(N\cdot Cdac\cdot Vdac+Cs1n\cdot Vs1n)/(N\cdot Cdac+Cs1n)$$

where N is a numerical value corresponding to the low order three bits. The output voltage V of the D/A converter is increased by suitably selecting the capacitance values of the capacitors and the voltage values so that the output voltage varying according to the numerical value N, which corresponds to the 3-bit digital data, is indicated by a S-like curve. Thus, an analog voltage is obtained by performing γ-correction on the analog voltage corresponding to the numerical value N.

Incidentally, in the case that the number of bits of the digital data is large, the voltages Vdac and Vs1n may be changed according to a value which is represented by high-order bits, to thereby obtain an analog voltage in a wide range.

Thus, this embodiment is configured as described above.

Figure 4:
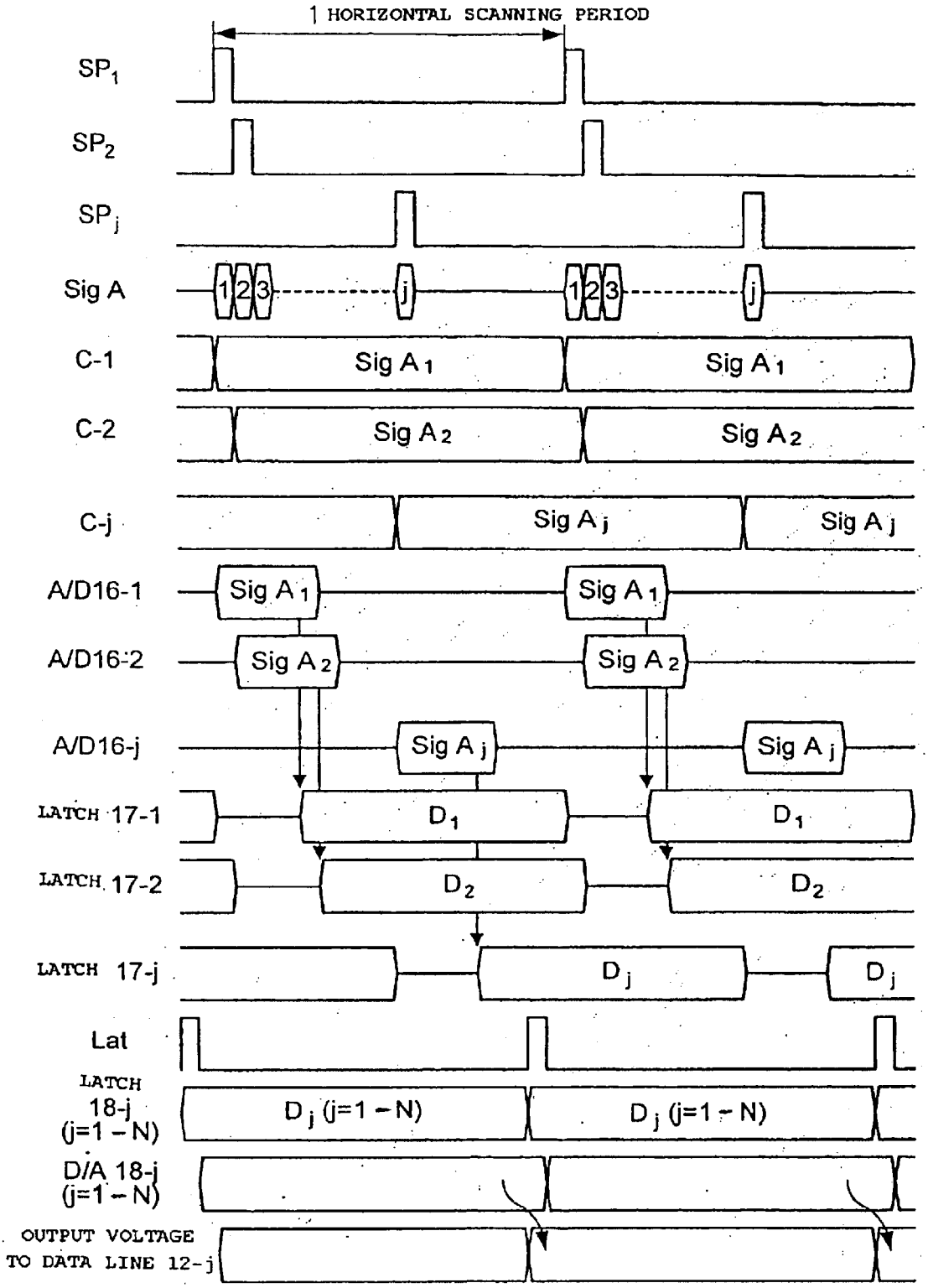
FIG. 4 is a timing chart illustrating an operation of the first exemplary embodiment.

FIG. 4 is a timing chart illustrating an operation of the aforementioned liquid crystal panel 1A. Hereunder, the operation of this embodiment is described with reference to this timing chart.

As illustrated in FIG. 4, in each horizontal scanning period, sampling pulses SPj (j=1 to N) are sequentially outputted from the data line driving circuit 14 so that the sampling switches SS-j (j=1 to N) are serially put into a conducting state. Then, an analog image signal Sig A inputted from an external circuit to the liquid crystal panel 1A is applied to the capacitors C-j through the sampling switches SS-j put into a conducting state. Thereafter, when the sampling switches SS-j is returned to a non-conducting state, the analog image signal Sig A is held by the capacitors C-j. As a result of sequentially performing such sampling operations by the sampling switches SS-j (j=1 to N), N samples Sig Aj (j=1 to N) of the analog image signals are sequentially held by the capacitors C-j (j=1 to N).

Each of the A/D converters 16-j (j=1 to N) starts to perform A/D conversion of the sample Sig Aj of the analog image signal (hereunder referred to simply as "analog sample") within a predetermined time that is shorter than one horizontal scanning period since the analog sample is held in the corresponding capacitor C-j. Then, digital signals Dj (j=1 to N) corresponding to N analog samples Sig Aj (j=1 to N) are serially outputted from each of the A/D converters 16-j (j=1 to N). Immediately after being outputted from each of the A/D converters, the digital signals Dj (j=1 to N) are held by the first latches 17-j (j=1 to N).

Subsequently, when a latch pulse Lat is outputted from the timing signal generating circuit 2, the digital signals Dj (j=1 to N) held in the first latches 17-j (j=1 to N) are simultaneously written to the second latches 18-j (j=1 to N). Immediately after that, the D/A converters 19-j (j=1 to N) start to perform D/A conversion on the digital signals Dj (j=1 to N) held in the second latches 18-j (j=1 to N). Upon completion of this D/A conversion, analog signals having undergone γ-correction are outputted from the D/A converters 19-j (j=1 to N) to the data lines 12-j (j=1 to N).

The analog signals transmitted through the data lines 12-j (j=1 to N) are applied to the pixel electrodes of the pixels Qij (j=1 to N) through the switching transistors Tij (j=1 to N) when the selection voltage pulses Gi for selecting the high level are outputted.

Similar operations are repeated in the subsequent horizontal scanning periods. Thus, the analog signals corresponding to all pixels of one screen are applied to the pixel electrodes of the pixels Qij (j=1 to N) of the liquid crystal panel 1A of FIG. 1, to thereby display an image.

As described above, according to this embodiment, the analog samples Sig Aj held by the capacitors C-j in response to the sampling pulses SPj are subsequently converted into the digital signals Dj within a short time. The digital signals Dj are held by the first latches 17-j and second latches 18-j until D/A conversion is commenced by the D/A converters 19-j. Thus, even when the analog samples Sig Aj held by the capacitors C-j are attenuated by the leakage, the voltage applied to each of the pixels is hardly affected by the leakage. Therefore, according to this embodiment, image displays of high picture quality can be achieved. Furthermore, according to this embodiment, the capacitance of each of the capacitors C-j (j=1 to N) can be reduced to a value that is smaller than those of the capacitors CA-j (j=1 to N) and CB-j (j=1 to N) of the liquid crystal panel 1 of FIG. 10. Moreover, the high speed sampling of the analog image signals is enabled. Furthermore, the power consumption of the circuit can be reduced.

Figure 5:
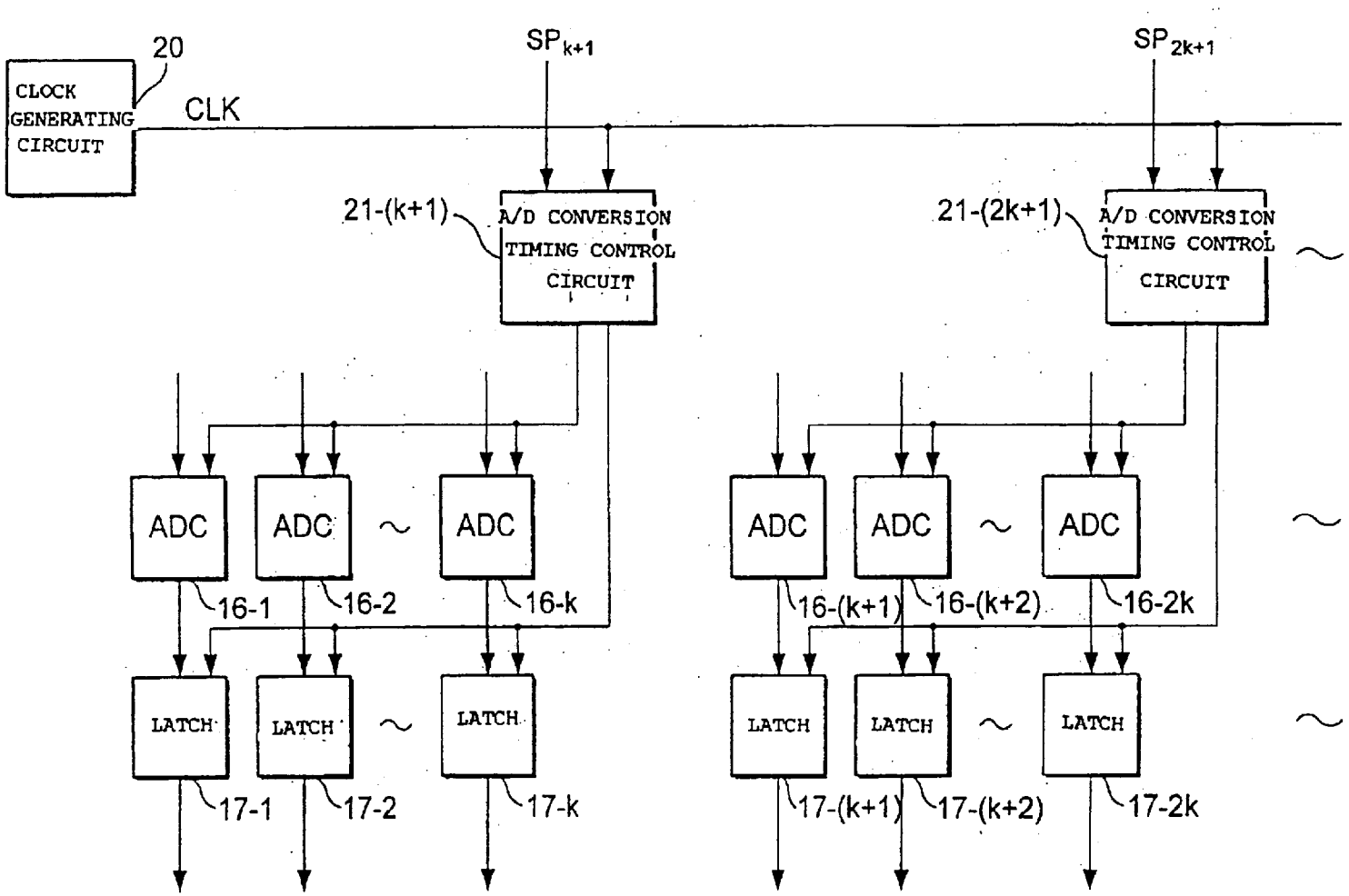
FIG. 5 is a block diagram illustrating the configuration of another example of the timing control circuit.

Incidentally, although the control signals for controlling the operation timing of each of the A/D converters 16-j and the first latches 17-j are generated in response to the output of each of the sampling pulses SPj in the aforementioned embodiment, N A/D converters 16-j (j=1 to N) and N first latches 17-j (j=1 to N) may be divided into groups, and the controlling of the A/D conversion and the writing operation may be performed on each group of the A/D converters and the first latches at one time. FIG. 5 illustrates the configuration of an example of the timing control circuit in such a case. In this case, the A/D converters 16-j (j=1 to N) and the first latches 17-j (j=1 to N) are divided into groups, each of which includes k A/D converters and k latches. Further, for instance, in the case of a first group, when a sampling pulse SPk+1 is outputted, the A/D conversion timing control circuit 21-(k+1) starts to control the operation timing of each of the A/D converters 16-j (j=1 to k) and the first latches 17-j (j=1 to k). Moreover, in the case of the next group, when a sampling pulse SP2k+1 is outputted, the A/D conversion timing control circuit 21-(2k+1) starts to control the operation timing of each of the A/D converters 16-j (j=k+1 to 2k)

and the first latches 17-j (j=k+1 to 2k). Similar operations are performed on the subsequent groups.

B. Second Exemplary Embodiment

Figure 6:
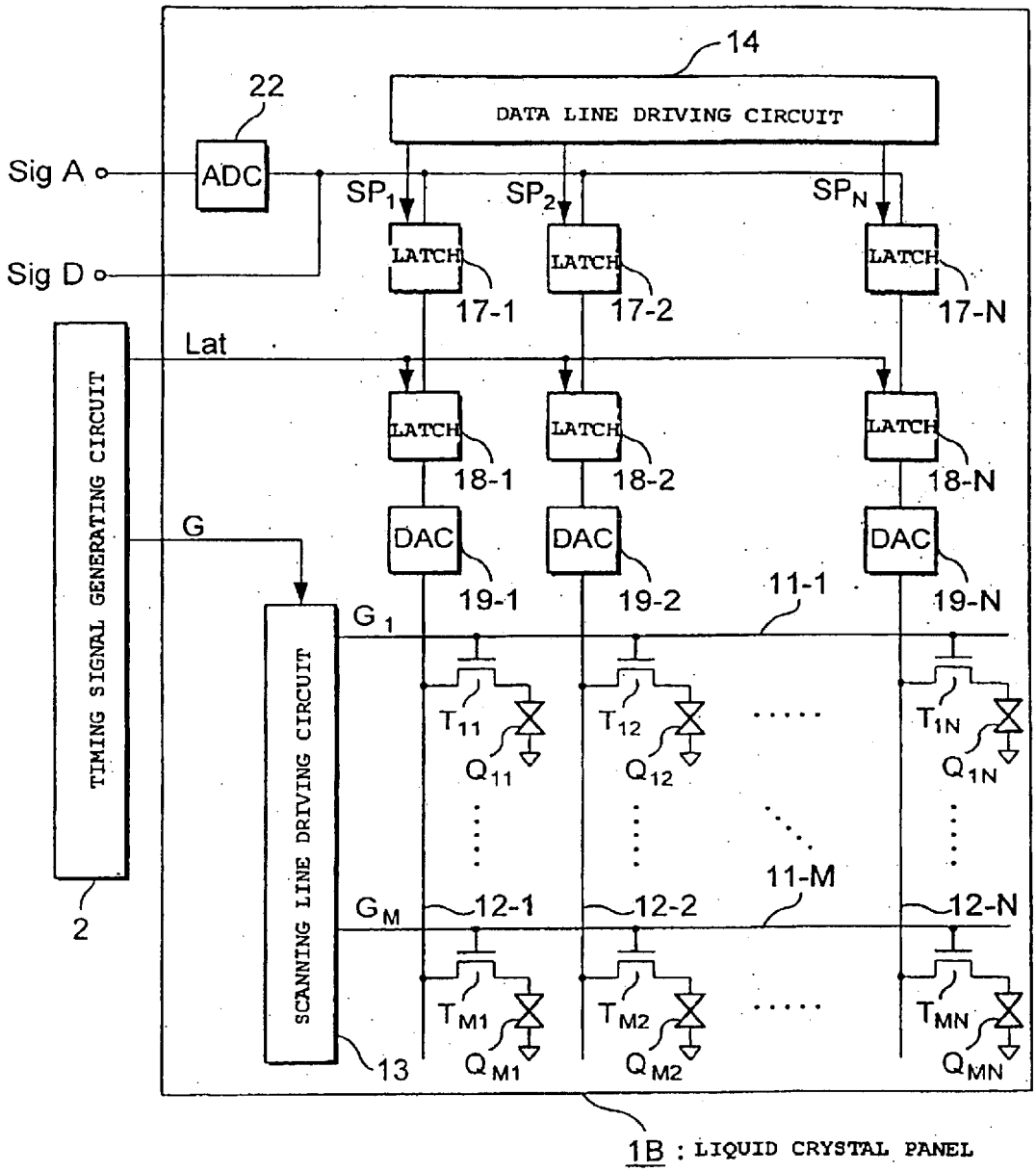
FIG. 6 is a block diagram illustrating the configuration of a liquid crystal panel according to a second exemplary embodiment of the present invention.

FIG. 6 is a block diagram illustrating the configuration of a liquid crystal panel 1B, which is a second exemplary embodiment of the present invention. Incidentally, in this figure, like reference characters denote portions corresponding to the components of the liquid crystal panel 1A illustrated in FIG. 1. The description of such portions is omitted. This liquid crystal panel 1B has no means equivalent to the sampling switches SS-j (j=1 to N), the capacitors C-j (j=1 to N), and the A/D converters 16-j (j=1 to N). Instead, this liquid crystal panel 1B has an A/D converter 22 to which an analog image signal is inputted from the exterior of the liquid crystal panel 1B. The A/D converter 22 repeats A/D conversion of this analog image signal N times in one horizontal scanning period. During one horizontal scanning period, the sampling pulses SPj (j=1 to N) are sequentially outputted by the data line driving circuit 14. The A/D converter 22 performs A/D conversion before the sampling pulses SPj are outputted. When the sampling pulses SPj are outputted, the digital signals obtained by the A/D conversion are supplied to the first latches 17-j (j=1 to N).

The sampling pulses SPj (j=1 to N) are supplied from the data line driving circuit 14 to the first latches 17-j (j=1 to N) as latch pulses. When the corresponding sampling pulse SPj supplied to each of the first latches 17-j, this first latch 17-j holds the digital signal outputted from the A/D converter 22 at that point in time.

This exemplary embodiment has an input path through which the digital image signal is inputted to the panel, in addition to another input path through which the analog image signal is inputted thereto. Thus, this exemplary embodiment can select one of these input paths. In the case of selecting the input path through which the digital image signal is inputted, a digital image signal Sig D is inputted from an external circuit to this liquid crystal panel 1B pixel-by-pixel in synchronization with the generation of the sampling pulse SPj (j=1 to N). Then, the digital image signals are serially written to the first latches 17-j (j=1 to N) in response to the sampling pulses SPj (j=1 to N).

The rest of the constitution of the second exemplary embodiment is similar to the corresponding part of the constitution of the first exemplary embodiment.

Figure 7:
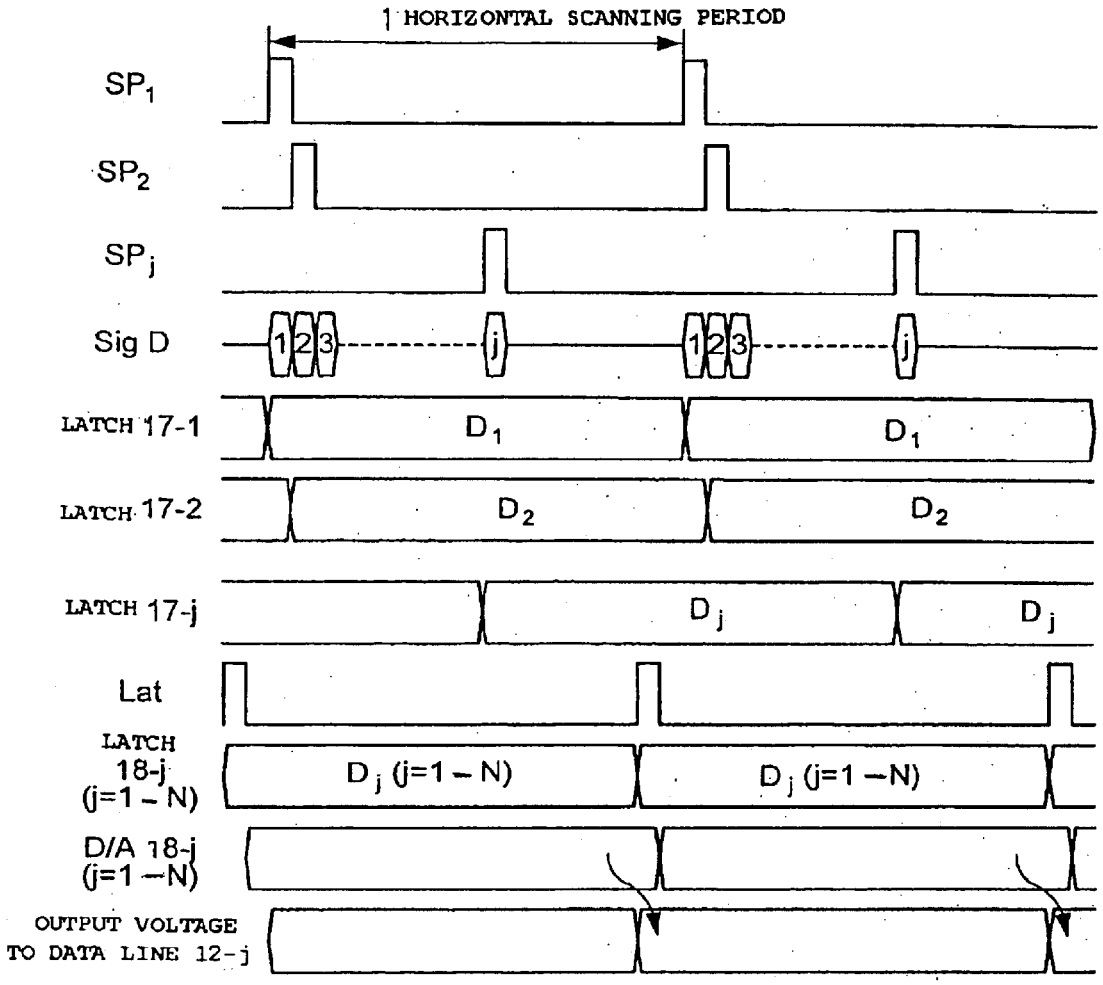
FIG. 7 is a timing chart illustrating an operation of the second exemplary embodiment.

FIG. 7 is a timing chart illustrating an operation of this exemplary embodiment.

As illustrated in this timing chart, in this embodiment, the digital signal Sig Dj corresponding to the analog sample Sig Aj is outputted from the A/D converter 22 at each output of the sampling pulse SPj. This digital signal Sig Dj is held by the first latch 17-j as the digital signal Dj.

The rest of the operation of the second exemplary embodiment is similar to a corresponding part of the operation of the first exemplary embodiment.

According to the second exemplary embodiment, the analog image signal supplied to the liquid crystal panel 1B is immediately converted into the digital signal, which is held by the first latch 17-j (j=1 to N) or the second latch 18-j (j=1 to N) until applied to the data line 12-j, and which is converted back into the analog signal when applied to the data line 12-j. Therefore, the analog image signal is hardly deteriorated during the process between the inputting of the analog image signal to the liquid crystal panel 1B and the applying thereof to the data line 12-j. Consequently, the image displays of high picture quality can be obtained.

Furthermore, the electro-optical device according to the second exemplary embodiment has the input path for the digital image signal, in addition to the input path for the analog image signal. Therefore, the electro-optical device according to the second exemplary embodiment can be applied to both the case of processing analog image signals and the case of processing digital image signals. Thus, in the case of manufacturing a plurality of kinds of electronic equipment requiring an electro-optical device, the electro-optical device serving as a part of the electronic equipment can be shared thereamong. Consequently, the manufacturing cost thereof can be reduced.

C. Third Exemplary Embodiment

Next, examples of an exemplary embodiment implemented by using the aforementioned liquid crystal panel 1A or 1B in electronic equipment are described hereinbelow.

First Example: Projector

Figure 8:
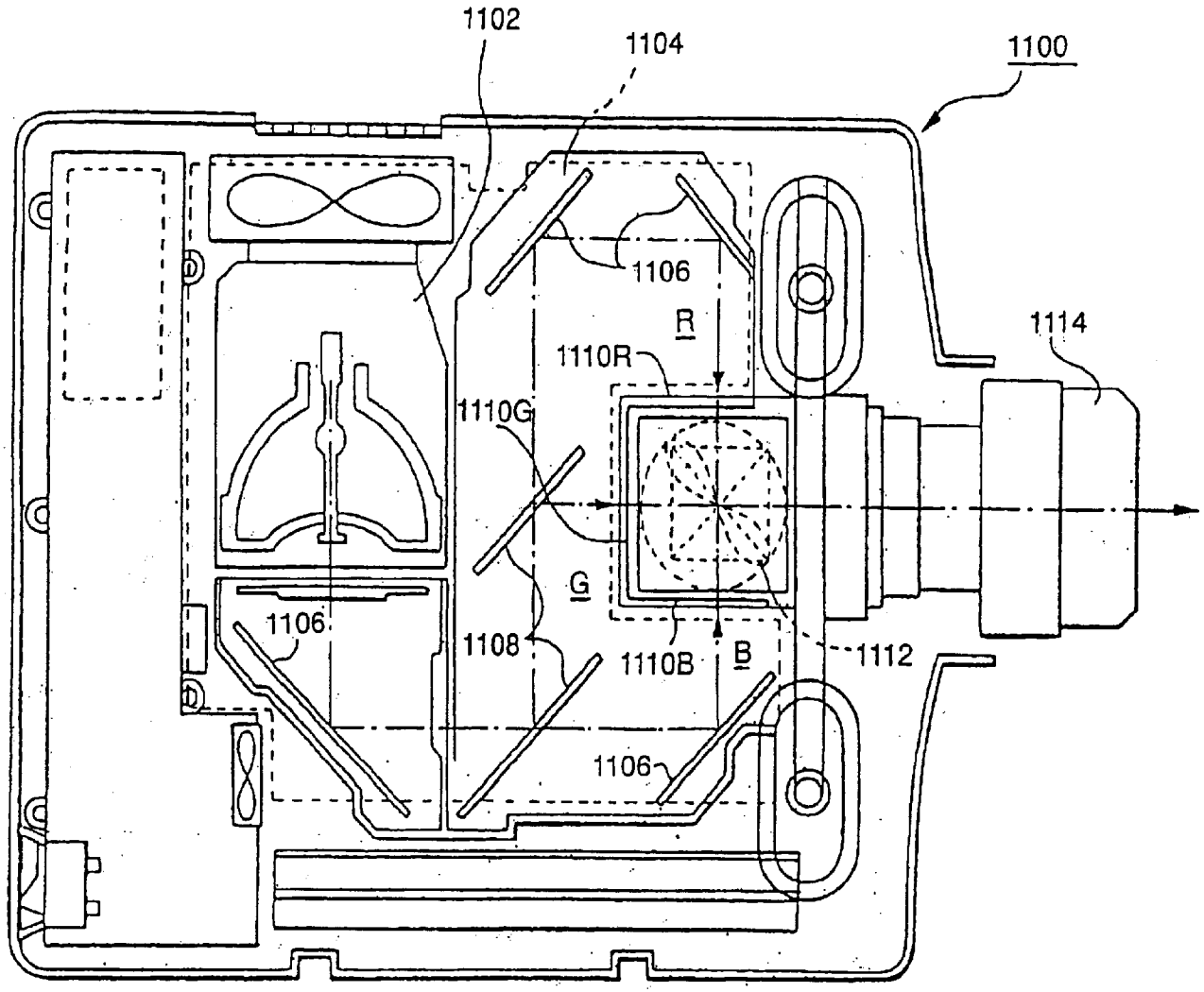
FIG. 8 is a diagram illustrating the configuration of a projector, which is an example of electronic equipment that is a third exemplary embodiment of the present invention.

First, a projector, in which this liquid crystal panel is used as a light valve, is described hereunder. FIG. 8 is a plan diagram illustrating the configuration of an example of a projector.

As illustrated in this figure, a lamp unit 1102 constituted by a white-light source, such as a halogen lamp, is provided in a projector 1100. Projection light radiated from this lamp unit 1102 is separated into three primaries, namely, R, G, B light rays by four mirrors 1106 and two dichroic mirrors 1108, which are placed in a light guide 1104. Then, the separated light rays are impinged upon liquid crystal panels 1110R, 1110G, and 1110B serving as light valves respectively corresponding to the primaries.

Each of the liquid crystal panels 1110R, 1110G, and 1110B has the same constitution as of the aforementioned liquid crystal panel 1A or 1B. Further, R, G, B primary signals supplied from an image signal processing circuit (not shown) are provided as the aforementioned analog image signals Sig A. The light rays modulated by these liquid crystal panels are incident upon a dichroic prism 1112 from three directions. This dichroic prism 1112 deflects the R and B light rays by 90 degrees. On the other hand, the G light ray rectilinearly travels. Therefore, a color image is synthesized from respective color component images, so that the color image is projected onto a screen through a projection lens 1114.

Incidentally, the light rays corresponding to the primaries R, G, B are incident upon the liquid crystal panels 1110R, 1110G, and 1110B by the dichroic mirror 1108. Thus, there is no need for providing a color filter on the opposing substrate.

Second Example: Mobile Computer

Figure 9:
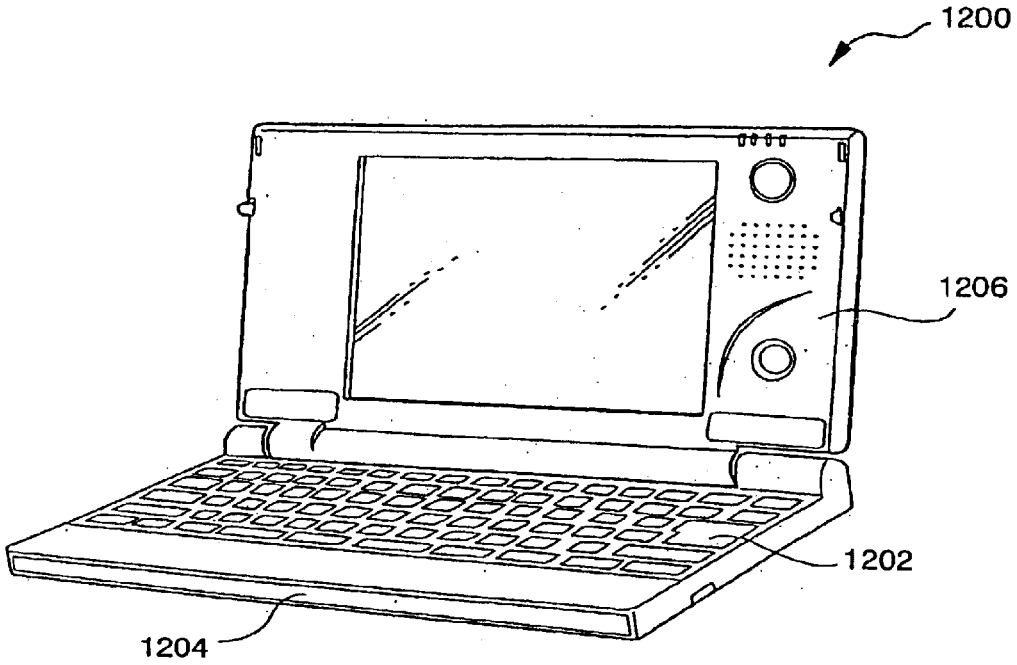
FIG. 9 is a block diagram illustrating the configuration of a mobile computer, which is another example of the electronic equipment.

Next, an example of applying this liquid crystal panel to a mobile computer is described hereinbelow. FIG. 9 is a plan diagram illustrating the configuration of this computer. As illustrated in this figure, the computer 1200 has a main unit portion 1204 having a keyboard 1202, and a liquid crystal display portion 1206. This liquid crystal display portion 1206 is constituted by enabling the aforementioned liquid crystal panel 1A or 1B to-be back-lit.

Incidentally, in addition to the examples of the electronic equipment described with reference to FIGS. 8 and 9, other examples are a liquid crystal television, a view-finder type or direct-view-type camcorder, a car navigation device, a pager, an electronic notepad, an electric calculator, a word processor, a workstation, a hand-portable telephone set, a TV phone, a POS terminal, and a device having a touch panel. Needless to say, the aforementioned liquid crystal panel of the present invention can be applied to various kinds of electronic equipment.

Additionally, although the active matrix liquid crystal panels using TFTs have been described by way of example, the present invention is not limited to thereto. The present invention can be applied to a device using TFDs (Thin Film Diodes), and a passive liquid crystal display device using STN liquid crystal. Moreover, the present invention can be applied to the case that the switching devices are integrally formed in a silicon substrate. Furthermore, the present invention is not limited to the liquid crystal display devices. The present invention can be applied to display devices adapted to display an image by utilizing various kinds of electro-optical effects, for example, by employing electroluminescence devices.

As above described, in the case of the electro-optical device or electronic equipment according to the present invention, inputted analog image signals are converted into digital image signals that are saved as digital signals until supplied to pixels. Therefore, analog image signals can be supplied to the pixels without being deteriorated by the switching noise and the leakage in the device. Consequently, image displays of high picture quality can be achieved. Further, according to the present invention, capacitors for holding analog image signals do not need to have high capacitance. Thus, the high speed sampling is enabled. Moreover, the power consumption of the device can be reduced.

What is claimed is:

1. A driving circuit for driving a plurality of pixels through N number of data lines, the driving circuit comprising:

N number of sampling switches, where N is a natural number;

N number of A/D converters, each of the N A/D converters converting a first analog signal that is supplied through one respective sampling switch of the N sampling switches into a digital signal;

N number of latches, each of the N latches storing said digital signal; and

N number of D/A converters, each of the N D/A converters converting said digital signal held in a corresponding latch of the N latches into a second analog signal to be supplied to said plurality of pixels, through a corresponding data line of the N data lines.

2. The driving circuit according to claim 1, the N sampling switch, the N A/D converters, the N latches, and the N D/A converters being disposed on one substrate.

3. An electro-optical device comprising:

N number of data lines, where N is a natural number;

M number of scanning lines, where M is a natural number;

a plurality of pixels disposed correspondingly to intersections of the N data lines and the M scanning lines;

N number of sampling switches;

N number of A/D converters, each of the N A/D converters converting a first analog signal that is supplied through one respective sampling switch of the N sampling switches into a digital signal;

N number of latches, each of the N latches storing said digital signal; and

N number of D/A converters, each of the N D/A converters converting said digital signal held in a corresponding latch of the N latches into a second analog signal to be supplied to a corresponding data line of the N data lines.

4. An electronic apparatus comprising said electro-optical device according to claim 3 as a display device.

5. An electro-optical device, comprising:

N number of data lines, where N is a natural number;

M number of scanning lines, where M is a natural number;

a plurality of pixels disposed correspondingly to intersections of the N data lines and the M scanning lines;

N sampling switches;

N number of A/D converters, each of the N A/D converters converting a first analog signal that is supplied through one respective sampling switch of the N sampling switches into a digital signal;

N number of latches, each of the N latches storing said digital signal outputted by a corresponding A/D converter of the N A/D converters; and N number of D/A converters, each of the N D/A converters converting said digital signal held in a corresponding latch of the N latches into a second analog signal to be supplied to a corresponding data line of the N data lines, the N data lines, the M scanning lines, the plurality of pixels, the N sampling switches, the N A/D converters, the N latches, and the D/A converters being disposed on one substrate.

6. A driving circuit for driving a plurality of pixels, the driving circuit comprising:

a sampling circuit that samples a first analog signal supplied through one sampling switch and holds a first analog signal to be inputted in one horizontal scanning period;

an A/D conversion circuit that after the sampling circuit samples and holds the first analog signal, converts said first analog signal held in said sampling circuit into a digital signal, once per horizontal scanning period;

a storage device that stores said digital signal; and a D/A conversion circuit that converts said digital signal, which is stored in said storage device, into a second analog signal to be supplied to said plurality of pixels.

7. The driving circuit according to claim 6, said sampling circuit, said A/D conversion circuit, said storage device, and said D/A conversion circuit being disposed on one substrate.

8. The driving circuit according to claim 7, said sampling circuit, said A/D conversion circuit, said storage device, said D/A conversion circuit, and said pixels comprising a plurality of thin film transistors formed on said substrate.

9. The driving circuit according to claim 6, said storage device storing said digital signal obtained from said A/D conversion circuit within a fixed period, and said D/A conversion circuit converting said digital signal stored in said storage device into said second analog signal to be supplied to the plurality of pixels.

10. The driving circuit according to claim 6, said D/A conversion circuit generating said second analog signal obtained by performing nonlinear conversion of said digital signal.

11. An electro-optical device comprising said driving circuit according to claim 6 and a plurality of pixels driven by said driving circuit.

12. An electronic apparatus comprising said electro-optical device according to claim 11 as a display device.

13. A driving circuit for driving a plurality of pixels, the driving circuit comprising:

a sampling circuit that samples a first analog signal and holds said first analog signal to be inputted in one horizontal scanning period;

an A/D conversion circuit that converts said first analog signal held in said sampling circuit into a digital signal;

a storage device that stores said digital signal; and a D/A conversion circuit that converts said digital signal, which is stored in said storage device, into a second analog signal to be supplied to said plurality of pixels, said A/D conversion circuit converting said first analog signal held in said sampling circuit into said digital signal within a time that is a shorter than said one horizontal scanning period, said digital signal being stored in said storage device.

14. A driving circuit for driving a plurality of pixels, the driving circuit comprising:

a sampling circuit that samples a first analog signal and holds said first analog signal to be inputted in one horizontal scanning period;

an A/D conversion circuit that converts said first analog signal held in said sampling circuit into a digital signal;

a storage device that stores said digital signal;

a D/A conversion circuit that converts said digital signal, which is stored in said storage device, into a second analog signal to be supplied to said plurality of pixels;

a path through which said digital signal is supplied from said A/D conversion circuit to said storage device; and a path through which an external digital signal is supplied from an external circuit to said storage device.

15. A driving circuit of an electro-optical device for displaying an image, by driving a plurality of pixels disposed in a matrix in response to an analog image signal, the driving circuit comprising:

a plurality of sampling circuits that sequentially sample and hold the analog image signal inputted in one horizontal scanning period;

a plurality of A/D converters that after the sampling circuits sample and hold the analog signal convert the analog image signals, which are held in the plurality of sampling circuits, into digital image signals;

a storage device that stores the digital image signals; and a plurality of D/A converters that converts the digital image signals, which are stored in the storage device, into the analog image signals to be supplied to the plurality of pixels;

wherein the plurality of A/D converters convert the analog image signals into the digital signals once per horizontal scanning period.

* * * * *